United States Patent [19]

Goodman

[11] Patent Number: 4,930,562

[45] Date of Patent: Jun. 5, 1990

[54] DECORATIVELY COVERED BLIND STRUCTURE

[75] Inventor: Barry I. Goodman, Miami, Fla.

[73] Assignee: Hunter Douglas Inc., Upper Saddle River, N.J.

[21] Appl. No.: 321,705

[22] Filed: Mar. 10, 1989

[51] Int. Cl.[5] ..... E06B 9/36

[52] U.S. Cl. ..... 160/236; 160/38

[58] Field of Search ..... 160/236, 38, 39, 900, 160/168.1, 176.1, 166.1, 178.1, 19; 5/493

[56] References Cited

U.S. PATENT DOCUMENTS

| | | | |
|---|---|---|---|
| 2,074,482 | 3/1937 | Martens | 160/236 |
| 2,914,122 | 11/1959 | Pinto | 160/166.1 X |
| 2,994,370 | 8/1961 | Pinto | 160/236 X |
| 3,463,217 | 8/1969 | Assael | 160/39 |
| 4,049,038 | 9/1977 | Hyman et al. | 160/166.1 |
| 4,079,770 | 3/1978 | Woodle | 160/39 X |
| 4,384,605 | 5/1983 | Schaeffer et al. | 160/178.1 X |
| 4,434,834 | 3/1984 | Ennes | 160/166.1 |
| 4,519,435 | 5/1985 | Stier | 160/236 X |
| 4,662,421 | 5/1987 | Basmadji et al. | 160/39 X |
| 4,828,002 | 5/1989 | Ashby | 160/902 X |

FOREIGN PATENT DOCUMENTS

| | | | |
|---|---|---|---|
| 0268573 | 5/1988 | European Pat. Off. | 160/166.1 |
| WO85/00849 | 2/1985 | PCT Int'l Appl. | 160/236 |

*Primary Examiner*—David M. Purol

*Attorney, Agent, or Firm*—Pennie & Edmonds

[57] ABSTRACT

A decorative member is disclosed for attachment to a valance or a vertical slat of a blind structure. The decorative member includes a substrate which fits into the valance or blind slat and a cover member which is attached to the substrate and covers the exposed edges of the valance or blind slat to which the member is attached.

16 Claims, 2 Drawing Sheets

4
4
5
10
13
1'
3
13
10
9'
3
5
2
6
4
6
6
10'
7'
9
1

DECORATIVELY COVERED BLIND STRUCTURE

BACKGROUND OF THE INVENTION

The invention relates to a decoratively covered blind structure. The blind structure can, for example, be either a valance employed across the top of a window blind or a slat member, typically a vertical slat member, of a window blind.

For aesthetic, functional, and comfort reasons it is sometimes desirable to cover a valance with a fabric type of material which either matches or is complimentary to the blinds of the window covering. Similarly, vertical slats of a vertical window blind construction are covered with a fabric like material. In either case, a presently accepted arrangement for effecting this result is to construct the valance or the vertical slat with grooves along its edge. These grooves are used to hold the fabric or fabric like material, which is slid into the valance or vertical slat and retained along its edges by the grooves. With this type of construction the grooves, which are formed by bending over the edges of the valance or slat, remain exposed.

Where the underlining structure of the valance or blind is opaque, the bent over edges usually produce an exposed strip of color which is contrasting with the fabric material attached to the valance or slat. To avoid this contrasting color, valances and vertical slats today are typically formed with transparent bent over edges for forming the grooves. This is done by co-extruding the valance or slat from plastic material with the major portion of the structure being formed from opaque material and just the bent over edges from clear plastic material. Constructions of this type still, however, result in visible exposed edges; and where the fabric material is a soft, non-shiny material, these edges are in contrast.

SUMMARY OF THE PRESENT INVENTION

In accordance with the teachings of the present invention, a decorative member is provided which can be inserted into the conventional valance or blind slat in such a way as to completely cover the valance and slat, including its bent over edges.

Generally, this result is provided by constructing the covering as a multiple structure, including a substrate and cover member attached to the substrate. The substrate has a width which is adapted to fit snugly within the grooves of the valance or slat while the cover member has a width wider than the valance or slat. The substrate can be either flat or one which has a width which fits within the grooves when it has been flexed to a convex shape. In order to utilize the cover member to cover the bent over edges of the valance or slat, it is secured to the substrate only along the central portion of the substrate and is free from the edges of the substrate. Thus, when the substrate is inserted, as by sliding, into the grooves of the valance or slat, the cover material can be positioned on the outside of the turned over edges of the valance or slat and cover these turned over edges. With this procedure, the cover material completely covers the valance or slat.

With applicant's decorative member the cover can be a fabric or a non-fabric material and is constructed to be rigid enough so as to retain its shape and covering ability without requiring attachment of the edges to any other structure. This is accomplished by making the cover material rigid enough so that it can extend freely in a vertical or lateral direction without drooping or falling over. One way to accomplish this is to prepleat the fabric material and secure it to the underlying substrate. In pleated form the pleats extend transversely to the length of the cover member and add to and enhance its rigidity. The cover member can also be constructed of two fabrics, a front fabric and a backing fabric. The backing fabric can be sewn directly to the front fabric. The backing fabric also permits the cover member to be secured to the underlying substrate by adhesive without concern of the adhesive bleeding through the front fabric. The backing fabric may be made of material which is more rigid than the face fabric to provide rigidity to the free edges. It can be of a soft material as well. Typically by putting the two together, that in itself creates the required rigidity.

As a decorative member for a valance, the length of the decorative member can be made greater than the front face of the valance and the ends of the member can be bent at right angles to cover the ends of the valance without requiring additional valance structure. Typically a valance, when attached to the wall over a window opening, extends from the wall three or four inches. The ability to bend and crease the decorative member thus permits covering of the ends of the valance without additional valance structure.

Applicant's invention also permits custom installation of fabric or fabric like valance coverings. The decorative member can be supplied in long, continuous lengths. The substrate member is be made of cardboard or similar, cuttable material so that the length of the decorative member, as controlled by the length of the valance, can be determined at the time of installation and cut to the appropriate size. The whole decorative member being made of cardboard and fabric like material is thus flexible and can be supplied in rolls of continuous lengths.

Not only can the decorative member be made of width so as to cover the entire valance structure in a vertical direction, it can also be made of an additional width so as to extend or hang down from the valance by any desired length. This is done simply by constructing the width of the fabric covering to the desired width and attaching it to the underlying substrate adjacent the top edge of the fabric material. No integrated hardware or other structure is required to produce this result. In this type of construction, the backing material has an additional function. In particular it acts as a light diffuser for the face fabric. Depending on the amount of light filtration desired, if any, to the valance skirt it can be controlled by controlling the density and construction of the backing fabric.

Where the decorative member is used for covering the vertical slats of a vertical blind, it not only provides a covering for the bent over edges of the slats, it also provides added advantages. In particular, the vertical slats which are generally made of plastic or metal tend to rattle when in the closed position when subjected to any breeze. This is because the vertical edges of the slats overlap and touch each other. With the decorative fabric covering member completely covering the slats, there is no plastic to plastic contact in the closed position of the slats. Instead, the contact is always one of plastic to fabric. This thus eliminates the noise factor found with this type vertical blind.

In addition, the fabric covered decorative member contributes to improving the light-blocking function of the blind when in closed position. This results from the added overlap of the individual slats as provided by the additional width of the fabric covering. It also results from the fabric adding to the sealing effect between the slats. This is particularly evident where the bent over edges of the slats are transparent. The fabric being opaque eliminates the transparent natural light gap when the uncovered slats are in closed overlapped position.

DETAILED DESCRIPTION OF THE INVENTION

Figure 1:
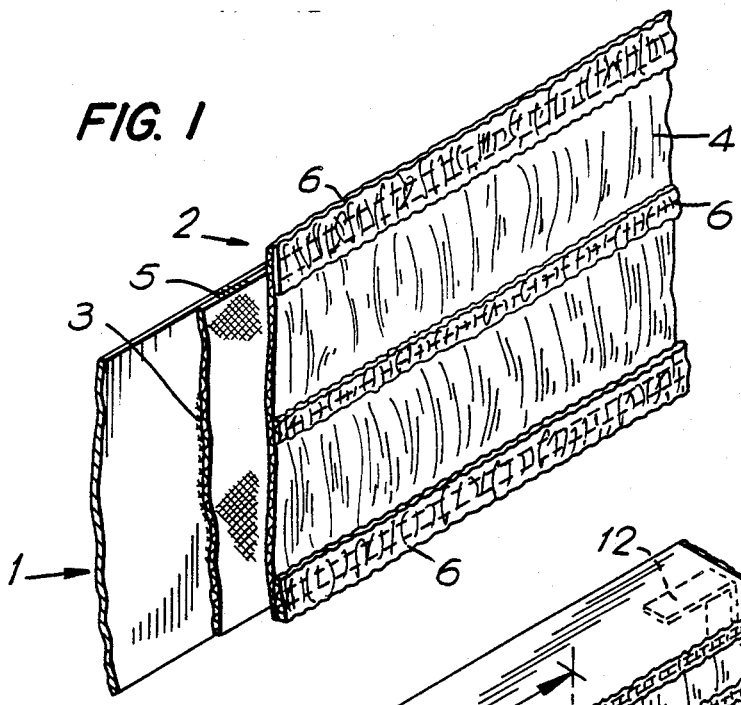
FIG. 1 is a perspective view, partially broken away, of the decorative member of the present invention.

FIG. 1 shows the decorative member of the present invention as including an elongated substrate 1 of self sustaining shape and a cover member 2 adhered to the substrate along a central area by an adhesive 3. The cover member is thus free from the substrate along its side edges. In FIG. 1 the cover member includes an outer cover of pleated fabric 4 and a backing fabric 5. The pleated fabric is sewn to braid material 6 along its edges and central portion and the cover fabric and backing fabric are themselves secured together by sewing along the braid 6.

Figure 2:
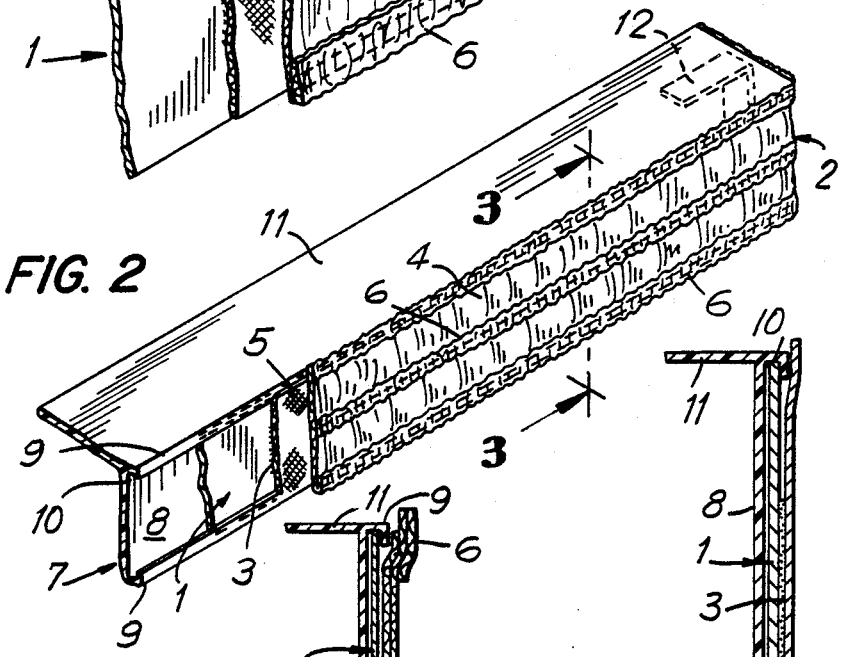
FIG. 2 is a perspective view of a decoratively covered valance blind structure of the present invention employing the decorative member of FIG. 1.
Figures 5, 6, 7:
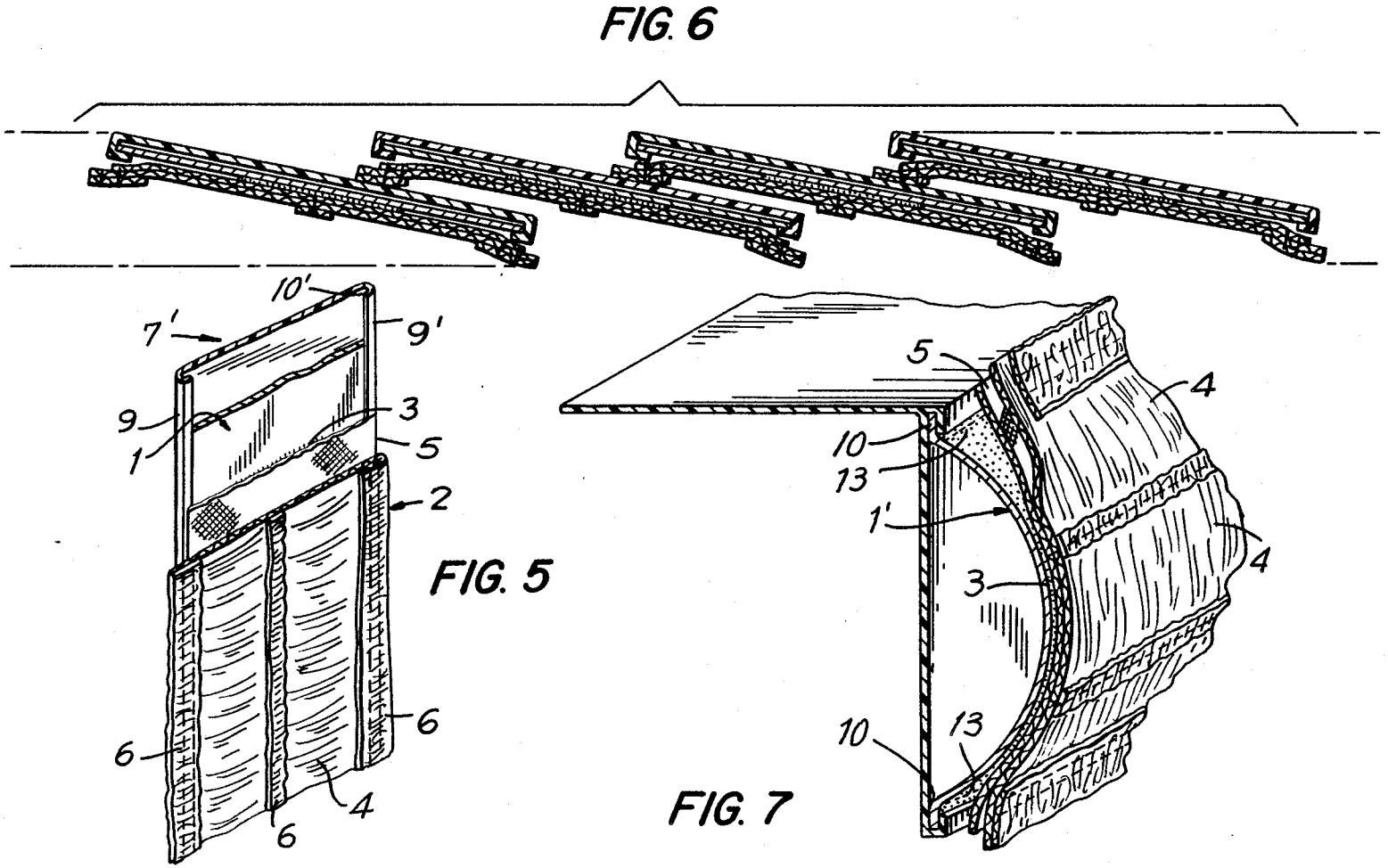
FIG. 5 is a perspective view of a decoratively covered vertical blind slat structure of the present invention employing the decorative member of FIG. 1.
FIG. 6 is a cross-sectional view of a plurality of vertical blind slats, each having a decorative member attached thereto.
FIG. 7 is a perspective view, partially broken away, of an alternative embodiment of the decorative member of the present invention mounted on a valance blind structure.

The decorative member shown in FIG. 1 is adapted to be secured to an elongated support member to form a decoratively covered blind structure which can either be a valance 7 as shown in FIG. 2 or a vertical slat 7' of a vertical blind as shown in FIGS. 5 and 6. In either case, the elongated support member of the resulting blind structure has a convex or generally flat support surface 8 or and turned over side edges 9 or 9'. These turned over sections define spaced facing grooves 10 or 10' along the edges. The spacing between these facing grooves is about equal to the width of the substrate 1 of the decorative member. Thus, the substrate 1 is positionable on the support surface 8 or 8' of the support member by inserting its edges into these facing grooves. This is typically done by inserting the decorative member endwise into the grooves. This leaves the front face of the substrate exposed between the grooves along a central area of this front face.

Since the fabric cover member 2 is secured to the substrate along this exposed central area and is free from the substrate along its edges, it can remain outside of the grooves and in covering relation to the bent over edges. This is clearly shown in both FIGS. 2 and 5 and is assured by using a cover member which has a width greater than the width of the substrate and a width which is at least as wide as the width of the support member 7 or 7'.

Figure 3:
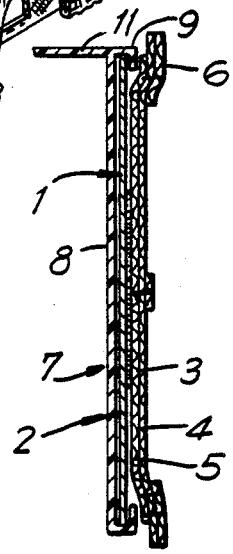
FIG. 3 is a cross-sectional view of the decorative member shown of FIG. 1 mounted on a valance blind structure.

FIG. 3 is a cross-sectional view showing the decoratively covered valance shown in FIG. 2. It shows the substrate 1 snugly fit into the grooves 10 on the valance with the adhesive attachment 3 of the cover member disposed between the bent over edges of the valance and the fabric extending in covering relationship to these bent over edges.

Figure 4:
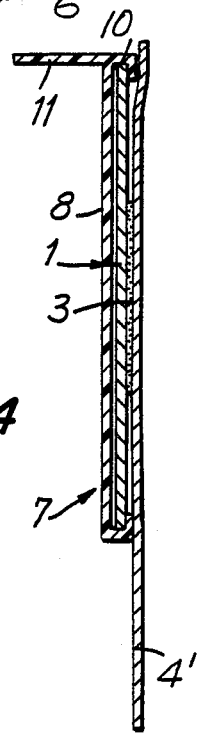
FIG. 4 is a cross-sectional view similar to FIG. 3 of an alternate embodiment of the decorative member.

FIG. 4 shows an alternative embodiment of the valance blind structure shown in FIG. 3. In this embodiment, the front cover member 4' is made of non-fabric rigid material. Thus the backing material of FIG. 3 can be eliminated and the front material attached directly to the substrate by the adhesive 3. FIG. 4 shows the construction in which the front cover member also has a width which is much greater than the width of the valance support member 7. The added width is located to one side of the substrate 1 so that it provides a cover which hangs down from the valance to any desired point. This same construction of the cover member hanging down from the valance can be used with the embodiment of FIG. 3. Also, it should be understood that although adhesive has been mentioned as the means for securing the cover member to its substrate, other means such as sewing, two-sided tape or hot-melt glue can be used, depending on the circumstances and the type of cover material being employed. The circumstances dictate the method of adhesion.

The valance shown in FIG. 2 includes a top portion 11 and a downwardly depending front skirt portion extending at right angles to the top portion. The skirt portion defines the flat surface 8 of the support member 7. With this type of valance construction, the grooved side edges run along the juncture of the top and skirt portions and along the bottom of the skirt portion. Generally, the valance is open at its ends and is made from extruded plastic material. With this construction, the valance can be cut to the desired length at the point of installation and attached to the wall or to the window or window covering by existing conventional methods.

With applicant's present invention the decorative member can be cut to a length equal to the length of the valance plus twice the width of the top portion 11. Thus, the ends of the decorative member as they extend beyond the ends of the valance can be bent and/or creased at right angles and turned back towards the wall. This is shown in FIG. 2 at the right end of the valance. The bent ends of the decorative member can be secured in place at right angles to the front of the valance by a suitable tape 12. With this construction the ends of the valance are finished without requiring additional valance structure and this can all be done in a custom manner at the point of installation.

There will be some installations which may require additional valance structure extending from the front of the valance back to the mounting wall surface. In these constructions, the decorative cover member is mounted on this additional structure in the same way as it is mounted on the front valance surface.

With the use of the decorative member as a covering for the vertical slats of a vertical blind, each blind slat is covered in a similar manner. This is shown in FIG. 6 where the slats are pivoted to a closed, overlapped position. As is clear from FIG. 6, the added width provided by the fabric covering helps in eliminating light leakage between the slats and also eliminates direct slat to slat contact of the overlapped edges. Instead, fabric to slat contact is provided. This has the advantage of reducing any noise which might otherwise be created due to slats moving relative to each other.

In the alternative embodiment shown in FIG. 7 the substrate 1' has a width generally equal to the spacing between the grooves 10 of the valance 7 when the substrate is flexed to a convex or bowed configuration. This can be done, for example, by preforming the substrate to the desired shape and width by extruding it from plastic material. Alternatively, one can use a flat, flexible substrate which has a width greater than the spacing between the grooves. Such a substrate can then be flexed to the convex shape and required width for insertion into the grooves. The convex construction gives a three dimensional or upholstered look to the valance.

As with the previous construction of the decorative member described above, a pleated fabric 4 with the backing fabric 5 is adhered to the substrate 1 by the adhesive 3. This adherence is along a central area of the substrate so as to leave the cover member free from the substrate along its edges. When the substrate is extruded from plastic, its cover member can be extruded as part of the substrate and be formed only at the elongated edges so as to cover the folded over edges of the valance when connected thereto.

To facilitate bending or flexing of the substrate to the bowed condition showed in FIG. 7, score lines 13 are provided in the substrate. These score lines are spaced from the edges of the substrate by distance about equal to the depth of the grooves 10. Thus the bending of the substrate into its bowed shape will extend across most of the width of the valance.

As with the embodiment of the decorative cover of FIG. 1 as used with a valance structure, the width of the fabric cover member of the construction shown in FIG. 7 can be greater than the width of the substrate. Therefore the fabric can hang down any length from the valance in the same manner as shown in FIG. 4. In addition, the substrate 1' can be shaped to a differently sized convex form or to other shapes, as desired.

I claim:

1. A decorative member in combination with an elongated support member having a support surface and turned over side edges defining spaced facing grooves of predetermined depth along said edges, said decorative member comprising:

(a) an elongated substrate having a self sustaining shape, front face and side edges defining a width about equal to the spacing between said facing grooves, said substrate being positionable on the support surface of the support member with the side edges held in said grooves and the front face exposed between the grooves along a central area of the face intermediate the side edges of the substrate; and (b) a cover member attached to said substrate along said central area and free from said substrate along its side edges, said cover member having a width greater than the width of said substrate and extending outwardly beyond the side edges thereof for covering the turned over side edges of the support member when the decorative member is positioned thereon.

2. A decorative member according to claim 1 wherein:

(a) the substrate is a flexible, rollable member of a length which is a multiple of the length of the support member with which it is to be used; and (b) the decorative member is cuttable into a length usable with said support member.

3. A decorative member according to claim 2 wherein:

(a) the cover member is a pleated fabric attached to said substrate with the pleats extending generally transversely to the length of the substrate.

4. A decorative member according to claim 3 wherein:

(a) the cover member includes a backing fabric sewn to the pleated fabric to maintain the pleats and add stiffness thereto.

5. A decorative member according to claim 4 wherein:

(a) the backing fabric is attached to said substrate by adhesive.

6. A decorative member according to claim 1 wherein:

(a) the substrate has a curved cross-sectional shape.

7. A decorative member according to claim 6 wherein:

(a) the substrate is flexible and has a width about equal to the spacing between the facing grooves when flexed to a curved cross-sectional shape.

8. A decorative member according to claim 7 wherein:

(a) the substrate has score lines extending along its side edges and spaced therefrom by a distance about equal to the depth of the grooves to permit bending of the substrate along the score lines.

9. A decoratively covered blind structure comprising:

(a) an elongated support member having a support surface and turned over side edges to define spaced facing grooves of predetermined depth along said edges; and (b) a decorative member comprising:

(i) an elongated substrate having a self sustaining shape, front face and side edges defining a width about equal to the spacing between said facing grooves, said substrate being positioned on the support surface of the support member with the side edges held in said grooves and the front face exposed between the grooves along an area of the face intermediate the side edges of the substrate, and (ii) a cover member attached to said substrate along its exposed area, said cover member having a width at least as wide as the width of the support member with the side edges of the cover member covering the turned over edges of the support member.

10. A decoratively covered blind structure according to claim 9 wherein:

(a) said support member is a valance having a top portion of a predetermined width and a downwardly depending front skirt portion with the skirt portion extending at right angles to the top portion and defining the flat surface of the support member and with the grooved side edges thereof running along the juncture of the top and skirt portions and the bottom of the skirt portion.

11. A decoratively covered blind structure according to claim 10 wherein:

(a) said decorative member has a length equal to the length of the front skirt portion of the support member plus twice the width of the top portion; and (b) said decorative member is bent at right angles at each end of the front skirt portion and secured in place to the top portion.

12. A decoratively covered blind structure according to claim 10 wherein:

(a) the decorative member includes a cover member of a width that extends upwardly sightly beyond the skirt portion of the valance and downwardly a greater distance beyond the skirt portion.

13. A decoratively covered blind structure according to claim 9 wherein:

(a) the substrate has a curved cross-sectional shape.

14. A decoratively covered blind structure according to claim 9 wherein:

(a) the substrate is flexible and has a width about equal to the spacing between the facing grooves when flexed to a curved cross-sectional shape.

15. A decoratively covered blind structure according to claim 14 wherein:

(a) the substrate has score lines extending along its side edges and spaced therefrom by a distance about equal to the depth of the grooves to permit bending of the substrate along the score lines.

16. A decoratively covered blind structure according to claim 9 wherein:

(a) said blind structure includes a plurality of vertically hung vertical slats, each of which is pivotably movable about a vertical axis from a blind open position to an overlapped blind closed position;

(b) each vertical slat defines an vertical elongated support member; and (c) the cover member of the decorative member is a fabric material.

* * * * *